United States Patent [19]

Hiott et al.

[11] 4,341,356

[45] Jul. 27, 1982

[54] PULVERIZER

[75] Inventors: Edward R. Hiott, Cottageville, S.C.; Sara E. Scheckel, Sanford, Fla.

[73] Assignee: Hiott & Bridges, Inc., Cottageville, S.C.

[21] Appl. No.: 160,076

[22] Filed: Jun. 16, 1980

[51] Int. Cl.[3] ..... B02C 19/08

[52] U.S. Cl. ..... 241/169.2; 241/199.9; 241/DIG. 27

[58] Field of Search ..... 241/168, 169, 169.1, 241/169.2, 199.8, 199.9, 199.11, 199.12, DIG. 27

[56] References Cited

U.S. PATENT DOCUMENTS 3,915,393 10/1975 Elkins ..... 241/168
4,003,523 1/1977 Doolittle ..... 241/169.2

FOREIGN PATENT DOCUMENTS 2260277 6/1974 Fed. Rep. of Germany ... 241/169.2

*Primary Examiner*—Mark Rosenbaum
*Attorney, Agent, or Firm*—Larry Harold Kline

[57] ABSTRACT

A device is disclosed for use in pulverizing materials comprising a base, a hole in the base, a holder shaped to fit within the hole, and a pulverizer shaped to fit within the holder.

9 Claims, 3 Drawing Figures

PULVERIZER

This invention relates to a device for pulverizing and more particularly to a device for pulverizing pills.

In a hospital or pharmacy, in the preparation of medications, the pulverizing of pills is often necessary. Present methods of pills being crushed involve the use of a small mortar and pestle. The present invention is an improvement on the mortar and pestle method and resolves many problems that presently exist.

An object of the present invention is to reduce nursing and pharmaceutical time and energy on dosage preparation with regard to pulverizing pills.

Another object of the present invention is to decrease dosage loss due to spilling and lost pills that jump over the side of a mortar.

Still another object of the present invention is to provide a device of durable construction eliminating replacement of old fashioned mortars and pestles.

A further object of the present invention is to provide a device which can pulverize pills fine enough to easily pass through a straw or small tube.

Another object of the present invention is to provide a device which can pulverize a plurality of pills simultaneously.

These and other objects and features of the present invention will be apparent from the following description and appended claims.

Briefly, the invention is a device for use in pulverizing materials. The device comprises a base and a hole in the base. Holding means is shaped to fit securely in the hole. The holding means is operative to hold the materials. A pulverizer is shaped to fit within the holding means. The pulverizer is operative to pulverize the materials in the holding means. The holding means comprises a rounded bottom. The pulverizer comprises a rounded pulverizing bottom. The rounded pulverizing bottom of the pulverizer is shaped larger than a hemisphere and smaller than a sphere. The pulverizer has a shaft secured to the rounded pulverizing bottom. The pulverizer has handle means secured to the shaft. The handle means may be a ball handle. The handle means may be connected to the base. The handle means may comprise a reinforced end connected to the base and a holding end connected to the reinforced end and secured to the pulverizer. A first ring connector may be secured to the end of the reinforced handle means. A second ring connector may be secured to the base. A chain link may be secured through the first ring connector and the second ring connector. The rounded pulverizing bottom of the pulverizer may be shaped in size to fit snugly within the rounded bottom of the holding means. The materials may be pills.

The invention will be more fully understood from the following detailed description and appended claims when taken with the drawings in which:

Figure 3:
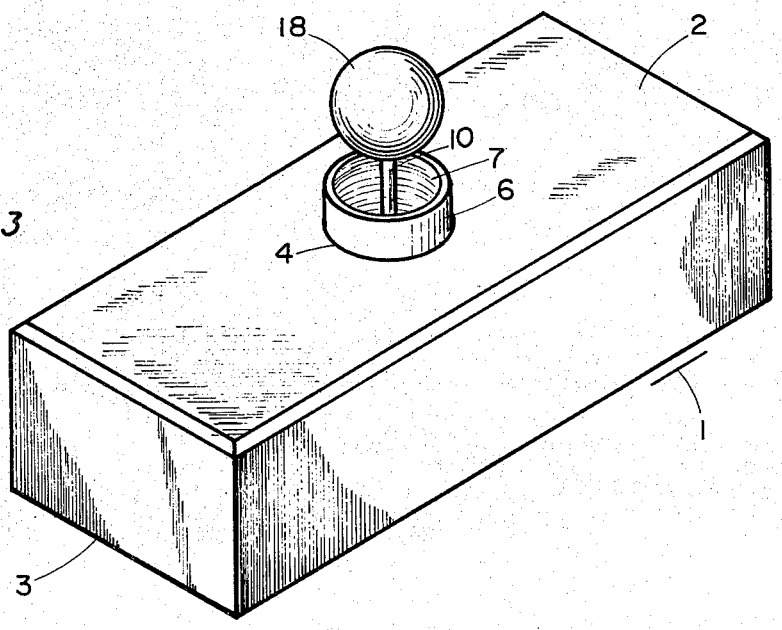

FIG. 3 is an isometric view of device 1 with ball handle 18 replacing handle 14, and without ring connectors 5 and 16, and chain link 17.

Figure 1:
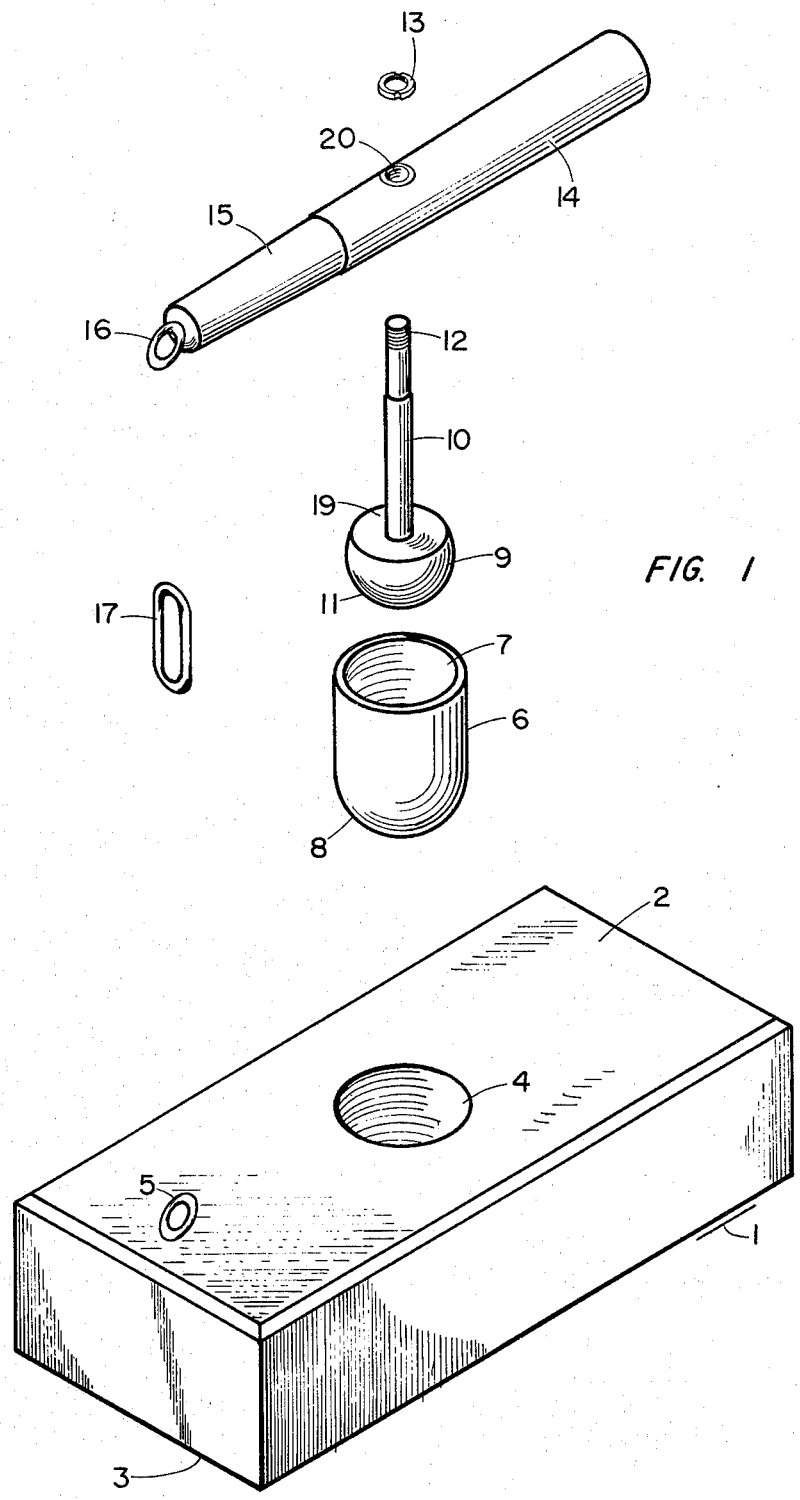
FIG. 1 is an exploded view of device 1.

Referring now to the drawings, FIG. 1 is an exploded view of device 1. Device 1 has a base with top 2, bottom 3, and a plurality of sides. Within top 2 is hole 4. Ring connector 5 is secured into top 2. Cup 6 is designed to fit into hole 4 in top 2. Cup 6 comprises an opening 7 in the top and a rounded bottom 8. Pulverizer 9 fits into the opening 7 in the top of cup 6. Pulverizer 9 is connected to shaft 10. Pulverizer 9 has a rounded pulverizing bottom 11 which fits snugly into the rounded bottom 8 of cup 6. Shaft 10 has a threaded top 12. Handle 14 has an opening 20. The threaded top 12 of shaft 10 is extended through the opening 20 in handle 14, and is secured by securing means, nut 13. Handle 14 has a reinforced end 15. Ring connector 16 is connected to reinforced end 15 of handle 14. Chain link 17 is connected through ring connector 16 and through ring connector 5 in top 2, thereby securing the handle 14 to the top 2 of the base of device 1. Pulverizer 9 has a rounded pulverizing bottom 11 and a flat top 19.

Figure 2:
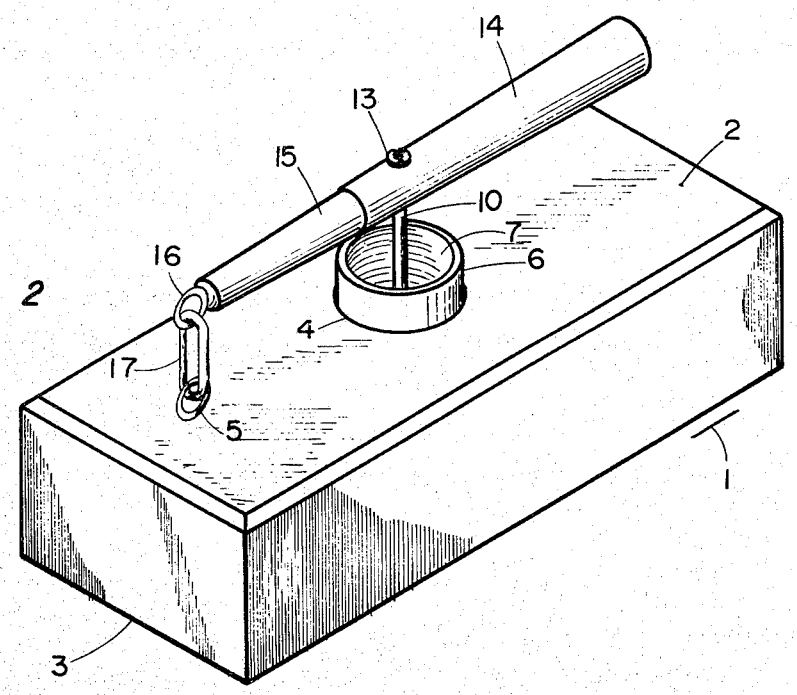
FIG. 2 is an isometric view of device 1.

FIG. 2 is an isometric view of device 1. In FIG. 2, the device 1 is in position to pulverize pills. One or more pills would be placed in cup 6. Handle 14 would be manually adjusted so that pulverizer 9 would enter opening 7 in the top of cup 6. Pulverizer 9 would pulverize pills in the rounded pulverizing bottom 8 of cup 6.

FIG. 3 is an isometric view of device 1. Ball handle 18 has replaced handle 14. Ring connectors 5 and 16, and chain link 17, are not utilized. Shaft 10, instead of extending through the opening 20 in handle 14, is secured within ball handle 18. Ball handle 18 is an example of a different type of handle which may be utilized with the present invention. The handles and linkage described herein in no way limit the many possibilities of handles and linkages which could be used with the present invention.

Any motion with pressure on pulverizer 9 will create the pulverizing effect. A grinding action is caused by the close fit of the pulverizer 9 into the cup 6 with rounded bottom 8. The rounded pulverizing bottom 11 of the pulverizer 9 enables a complete pulverizing action within the rounded bottom 8 of cup 6. This invention enables pressure to be placed, by the pulverizer 9 in the cup 6, with movement in any direction of the shaft 10, when the rounded pulverizing bottom 11 of pulverizer 9 is in contact with the rounded bottom 8 of cup 6.

The pulverizer 9 may be a ball pulverizer. The ball pulverizer has a rounded bottom and a flat top. The ball pulverizer may be designed to be more than half of a sphere, therefore, making better contact with the inside walls of cup 6 when the shaft 10 is moved in various directions. The device is designed for easy cleaning of all parts and eliminates contamination of one element with another.

The present invention may be utilized to pulverize or crush other materials. Cooking materials such as herbs or garlic may be pulverized with the present invention. Various types of testing of materials may desire pulverizing materials. The present invention can be made of any size to perform any task desired. The present invention is constructed to be durable. If any part should deteriorate, it is easily replaceable without replacing the whole device. The device is useful in mashing pills and is capable of pulverizing pills that might be difficult to crush in a small mortar and pestle.

The handle means utilized may be a handle such as handle 14 which is connected to the top 2 of the base of device 1, or it may be a handle such as ball handle 18 which is not connected to the base of device 1.

The present invention reduces nursing and pharmaceutical time and energy on dosage preparation. The device makes it easy to crush a multiplicity of pills. The device eliminates waste by preventing pills from jumping over the side of a mortar. The device is designed to eliminate the constant replacement of the old fashioned mortar and pestle. The device is designed so that it can be neatly set out and seen in order to prevent theft or misplacement. The present invention pulverizes pills fine enough to easily pass through small tubes or straws. Handle 14 has a reinforced end 15 which is connected to the top 2 of the base. The reinforced end 15 increases the durability and serviceability of the device 1.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

We claim:

1. A device for use in pulverizing materials comprising:

a. a base;

b. a hole in said base;

c. holding means shaped to fit securely in said hole, comprising a rounded bottom and a circular interior surface of the same diameter from said rounded bottom to the top of said holding means, and operative to hold said materials; and d. a pulverizer comprising:

(1) a rounded pulverizing bottom in the shape of a hemisphere and of similar shape, but of slightly smaller dimensions, than said rounded bottom of said holding means;

(2) a rounded upper portion comprising a rounded side with any section of said rounded side being contiguous with said rounded pulverizing bottom, said rounded pulverizing bottom and said rounded upper portion being in the shape of a truncated sphere, said rounded side being operable as a pulverizing side segment in contact with said holding means rounded bottom and the lower portion of said circular interior surface of said holding means; and (3) a shaft secured to said rounded upper portion, said shaft movable causing said rounded pulverizing bottom to move against said holding means rounded bottom and said rounded side of said rounded upper portion to be used as a pulverizing side segment in contact with said holding means rounded bottom and said lower portion of said circular interior surface of said holding means dependent on the movement of said pulverizer by said shaft, whereby said rounded pulverizing bottom and said rounded upper portion of said pulverizer are shaped and sized to fit snugly within said holding means rounded bottom and said lower portion of said circular interior surface of said holding means, whereby when said materials are placed into said holding means and said shaft is moved with pressure in any direction, said materials are pulverized between said pulverizer and said holding means.

2. A device according to claim 1 wherein said pulverizer further comprises handle means secured to said shaft.

3. A device according to claim 2 wherein said handle means is a ball handle.

4. A device according to claim 2 wherein said handle means is connected to said base.

5. A device according to claim 4 wherein said handle means comprises a reinforced end connected to said base and a holding end connected to said reinforced end and secured to said pulverizer.

6. A device according to claim 5 wherein said device further comprises:

a. a first ring connector secured to said reinforced end of said handle means;

b. a second ring connected secured to said base; and c. a chain link secured through said first ring connected and said second ring connector;

whereby said handle means is secured to said base.

7. A device according to claim 1 wherein said rounded pulverizing bottom of said pulverizer is shaped larger than a hemisphere and smaller than a sphere.

8. A device according to claim 7 wherein said materials are pills.

9. A device according to claim 1 wherein said materials are pills.

* * * * *